US008747081B2

(12) United States Patent
Kang et al.

(10) Patent No.: US 8,747,081 B2
(45) Date of Patent: Jun. 10, 2014

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 12/739,035

(22) PCT Filed: Oct. 10, 2008

(86) PCT No.: PCT/KR2008/005996

§ 371 (c)(1),
(2), (4) Date: Apr. 21, 2010

(87) PCT Pub. No.: WO2009/054636

PCT Pub. Date: Apr. 30, 2009

(65) Prior Publication Data

US 2010/0260627 A1 Oct. 14, 2010

(30) Foreign Application Priority Data

Oct. 24, 2007 (KR) ..... 10-2007-0107301
Oct. 24, 2007 (KR) ..... 10-2007-0107360

(51) Int. Cl.
*F04B 35/04* (2006.01)
*H02K 33/02* (2006.01)

(52) U.S. Cl.
CPC ..... *F04B 35/045* (2013.01)
USPC ..... 417/417; 310/15

(58) Field of Classification Search
CPC ..... F04B 35/045
USPC ..... 417/416, 417; 310/14, 15, 24; 267/179
See application file for complete search history.

(56) References Cited

U.S. PATENT DOCUMENTS 4,174,189 A * 11/1979 Elson ..... 417/363
4,351,521 A * 9/1982 Erdos ..... 472/104

(Continued)

FOREIGN PATENT DOCUMENTS

JP 62199993 A * 9/1987
KR 2003-0073668 9/2003

(Continued)

OTHER PUBLICATIONS

English translation of JP 62199993 abstract/constitution Sep. 1987.*

(Continued)

*Primary Examiner* — Charles Freay
(74) *Attorney, Agent, or Firm* — Ked & Associates, LLP

(57) ABSTRACT

A linear compressor is provided that includes a stationary member including a cylinder that provides a space to compress a refrigerant; a movable member linearly that reciprocates with respect to the stationary member, and includes a piston that compresses the refrigerant inside the cylinder and a supporter piston connected to the piston and having a support portion that extends in a radial direction of the piston; front main springs positioned so as to be symmetrical with respect to centers of the piston and the supporter piston, one end of each of which is supported by a front surface of the support portion of the supporter piston and the other end of each of which is supported by the stationary member; a rear main spring positioned at an opposite side of the piston, one end of which is supported by the supporter piston; and a back cover having a support portion that constrains the other end of the rear main spring from moving in a transverse direction.

15 Claims, 12 Drawing Sheets

(56) References Cited

U.S. PATENT DOCUMENTS

| | | | | |
|---|---|---|---|---|
| 4,427,349 | A * | 1/1984 | Elson | 417/363 |
| 4,474,537 | A * | 10/1984 | Dolz | 417/44.1 |
| 4,511,314 | A * | 4/1985 | Fraser et al. | 417/363 |
| 5,704,771 | A * | 1/1998 | Fujisawa et al. | 417/417 |
| 5,934,884 | A * | 8/1999 | Son | 417/363 |
| 6,004,113 | A * | 12/1999 | Vay | 417/363 |
| 6,413,057 | B1 * | 7/2002 | Hong et al. | 417/416 |
| 6,716,001 | B2 * | 4/2004 | Kim | 417/363 |
| 6,742,998 | B2 * | 6/2004 | Kawahara et al. | 417/416 |
| 6,793,470 | B2 * | 9/2004 | Song et al. | 417/417 |
| 6,881,042 | B2 * | 4/2005 | Heo et al. | 417/417 |
| 7,124,678 | B2 * | 10/2006 | Lee et al. | 92/140 |
| 7,331,772 | B2 * | 2/2008 | Jung et al. | 417/417 |
| 7,537,438 | B2 * | 5/2009 | Song et al. | 417/417 |
| 7,591,638 | B2 * | 9/2009 | Lee et al. | 417/415 |
| 7,626,289 | B2 * | 12/2009 | Her | 310/12.04 |
| 8,241,015 | B2 * | 8/2012 | Lillie et al. | 417/416 |
| 8,496,435 | B2 * | 7/2013 | Nannoni et al. | 416/140 |
| 2001/0043870 | A1 * | 11/2001 | Song | 417/363 |
| 2003/0170128 | A1 * | 9/2003 | Song et al. | 417/363 |
| 2004/0104625 | A1 * | 6/2004 | Wakuda et al. | 310/15 |
| 2005/0142002 | A1 * | 6/2005 | Kang et al. | 417/312 |
| 2006/0061025 | A1 * | 3/2006 | Deigner et al. | 267/170 |
| 2006/0251529 | A1 * | 11/2006 | Kim | 417/417 |
| 2007/0148018 | A1 * | 6/2007 | Her | 417/417 |
| 2007/0194507 | A1 * | 8/2007 | Kato et al. | 267/179 |
| 2010/0260628 | A1 * | 10/2010 | Kim | 417/417 |
| 2010/0260629 | A1 * | 10/2010 | Kang et al. | 417/417 |
| 2010/0266429 | A1 * | 10/2010 | Kang et al. | 417/417 |
| 2010/0290936 | A1 * | 11/2010 | Kang et al. | 417/417 |
| 2010/0320660 | A1 * | 12/2010 | Takeda et al. | 267/168 |

FOREIGN PATENT DOCUMENTS

| | | |
|---|---|---|
| KR | 10-0480087 | 3/2005 |
| KR | 10-2006-0025109 | 3/2006 |
| KR | 10-2007-0075887 | 7/2007 |
| KR | 10-2007-0075913 | 7/2007 |

OTHER PUBLICATIONS

Korean Office Action dated Jul. 12, 2013.

* cited by examiner

LINEAR COMPRESSOR

TECHNICAL FIELD

The present invention relates to a linear compressor, and more particularly, to a linear compressor, which is provided with three main springs having a resonance frequency matched to a driving frequency of the linear compressor, and includes a back cover having a support portion for constraining the movement of a rear main spring in a transverse direction.

Additionally, the present invention relates to a linear compressor, which is provided with three main springs having a resonance frequency matched to a driving frequency of the linear compressor, and enables accurate driving as the center of a rear main spring coincides with the center of a piston.

BACKGROUND ART

In general, a compressor is a mechanical apparatus for compressing the air, refrigerant or other various operation gases and raising a pressure thereof, by receiving power from a power generation apparatus such as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

Recently, a linear compressor which can improve compression efficiency and simplify the whole structure without a mechanical loss resulting from motion conversion by connecting a piston directly to a linearly-reciprocated driving motor has been popularly developed among the reciprocating compressors.

Normally, in the linear compressor, a piston is linearly reciprocated in a cylinder by a linear motor inside a hermetic shell, for sucking, compressing and discharging a refrigerant. The linear motor includes a permanent magnet disposed between an inner stator and an outer stator, and the permanent magnet is linearly reciprocated due to a mutual electromagnetic force. As the permanent magnet is driven in a state where it is coupled to the piston, the piston is reciprocated linearly inside the cylinder to suck, compress, and discharge the refrigerant.

FIG. 1 is a view illustrating a conventional linear compressor. FIG. 2 is a side cross sectional view enlargedly illustrating a portion A of FIG. 1. FIG. 3 is a graph illustrating the amount transverse displacement of a rear spring in accordance with the amount of compression in the conventional linear compressor.

Referring to FIG. 1, in the conventional linear compressor 1, a piston 30 is linearly reciprocated inside a cylinder 20 by a linear motor 40 in a hermetic shell 10 so as to suck, compress and discharge refrigerant. The linear motor 40 includes an inner stator 42, an outer stator 44, and a permanent magnet

46. The permanent magnet 46 is linearly reciprocated between the inner stator 42 and the outer stator 44 due to a mutual electromagnetic force. As the permanent magnet 46 is driven in a state where it is coupled to the piston 30, the piston 30 is linearly reciprocated inside the cylinder 20 to suck, compress and discharge refrigerant.

The linear compressor 1 further includes a frame 52, a stator cover 54, and a back cover 56. The linear compressor may have a configuration in which the cylinder 20 is fixed by the frame 52, or a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. A discharge cap 64 and a discharge muffler 66 are installed at the front of the discharge valve 62, and the discharge cap 64 and the discharge muffler 66 are fixed to the frame 52. One end of the inner stator 42 or outer stator 44 as well is supported by the frame 52, and an O-ring or the like of the inner stator 42 is supported by a separate member or a projection formed on the cylinder 20, and the other end of the outer stator 44 is supported by the stator cover 54. The back cover 56 is installed on the stator cover 54, and a suction muffler 70 is positioned between the back cover 56 and the stator cover 54.

Further, a supporter piston 32 is coupled to the rear of the piston 30. Main springs 80 whose natural frequency is adjusted are installed at the supporter piston 32 so that the piston 30 can be resonantly moved. The main springs 80 are divided into front springs 82 whose both ends are supported by the supporter piston 32 and the stator cover 54 and rear springs 84 whose both ends are supported by the supporter piston 32 and the back cover 56. Here, the main springs 80 include four front springs 82 and four rear springs 84. Accordingly, this large number of the main springs 80 leads to a large number of positional parameters to be controlled in order to maintain balance upon movement of the piston 30. Consequently, the manufacturing process becomes complicated and longer and the manufacturing cost is high.

Referring to FIG. 2 enlargedly illustrating a portion A of FIG. 1, members for supporting the rear spring 84 inside the back cover 56 in the conventional art can be understood in detail. A support portion 58 of the supporter piston 32 and a support portion 59 of the back cover 56 assists the rear spring 84 for resonant movement of the piston 30 while supporting both ends of the rear spring 84.

Referring to FIG. 3, the amount transverse displacement of the rear spring in accordance with the amount of compression in the conventional linear compressor can be understood.

First, with regard to the generation of an amount of transverse displacement upon compression of the rear spring 84 shown in the upper part of the graph, the rear spring 84 is compressed and expanded to repeat resonant movement by being supported by the supporter piston 32 and the back cover 56. Now, a case will be assumed in which the amount transverse displacement of the rear spring 84 is large because of the compression of the rear spring 84. By measurement of the movement of the rear spring 84, a measured value can be shown by a graph wherein the amount of compression and the amount of transverse displacement are an X-axis and a Y-axis, respectively.

In other words, if the rear spring 84 is compressed and moved at $\delta min$ to $\delta max$, a measured value having a amount of transverse displacement of Ymin to Ymax of the rear spring 84 is shown by a graph in which the amount of transverse displacement is the smallest when the amount of compression is the smallest and the largest, and the amount of transverse displacement is the largest when the amount of compression is intermediate.

Here, as an amount of transverse displacement is generated at the rear springs 84, this causes an unnecessary contact inside the back cover, produces impurities caused by damage and abrasion of the rear springs, and generates noise.

FIG. 4 is a side view schematically illustrating a case where a gap between the rear spring and the back cover support portion is made larger in the conventional art.

Referring to FIG. 4, it can be seen that when a gap between the lower end of the rear spring 84 and the back cover support portion 59 is made larger, there is no gap formed between the upper end of the rear spring 84 and the support portion 58. Compared with FIG. 3, it is adjusted so as to avoid contact by forming a gap between the support portion 59 of the back cover and rear spring 84. However, axial eccentricity is generated at the upper end portion and the lower end portion due to a manufacturing tolerance caused upon manufacturing of the rear springs 84. As shown in FIG. 4, this gives rise to abrasion of the upper end portions of the rear springs 84 and the support portion 58 of the supporter piston, thereby generating impurities and causing noise.

FIG. 5 is a side view schematically illustrating the shape of a real object in accordance with an eccentricity (e) generated from the rear spring in the conventional art.

Referring to FIG. 5, it can be understood that there exists an axial eccentricity at the upper end portion and lower end portion due to a manufacturing tolerance upon manufacturing of the rear springs 84. Due to the eccentricity, when the rear spring 84 receives an external force, as shown in FIG. 4, abrasion takes place at the upper end portion of the rear spring 84 and the support portion 58 of the supporter piston. Of course, the lower end portion of the rear spring 84 also may undergo unnecessary abrasion at the back cover 56.

As such, in FIGS. 2 to 4, an amount of transverse displacement generated upon compression and expansion of the rear spring 84 and an axial eccentricity of the rear spring give rise to unnecessary contact inside the back cover, produce impurities caused by damage and abrasion of the rear springs, and generate noise.

As described above, since the conventional linear compressor includes four front springs and four rear springs at longitudinally and laterally symmetrical positions, this requires a large number of main springs and a large number of positional parameters to be controlled in order to maintain balance upon movement of the piston. Consequently, the manufacturing process becomes complicated and longer and the manufacturing cost is high.

In addition, when the rear springs are compressed and expanded, an amount of transverse displacement is generated, thereby leading to an interference at the skirt portion of the back cover, generating impurities due to the abrasion and damage of the rear springs, and causing a noise problem.

FIG. 6 is a side cross sectional view schematically illustrating a conventional linear compressor. FIG. 7 is a side cross sectional view enlargedly illustrating a front main spring part of FIG. 6.

Referring to FIG. 6, in the conventional linear compressor 1, a piston 30 is linearly reciprocated inside a cylinder 20 by a linear motor 40 in a heimetic shell 10 so as to suck, compress and discharge refrigerant. The linear motor 40 includes an inner stator 42, an outer stator 44, and a permanent magnet 46. The permanent magnet 46 is linearly reciprocated between the inner stator 42 and the outer stator 44 due to a mutual electromagnetic force. As the permanent magnet 46 is driven in a state where it is coupled to the piston 30, the piston 30 is linearly reciprocated inside the cylinder 20 to suck, compress and discharge refrigerant.

The linear compressor 1 further includes a frame 52 and a back cover 56. The linear compressor may have a configuration in which the cylinder 20 is fixed by the frame 52, or a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. A discharge cap 64 and a discharge muffler 66 are installed at the front of the discharge valve 62, and the discharge cap 64 and the discharge muffler 66 are fixed to the frame 52.

One end of the inner stator 42 or outer stator 44 as well is supported by the frame 52, and the back cover 56 is supported by the outer stator 44.

A piston flange 33 projected at one end of the piston 30 in a radial direction is elastically supported in the movement direction of the piston 30 by the front springs 82 and rear springs 84 whose natural frequency is adjusted so that the piston 30 can perform resonant movement.

Here, there is formed a simple structure having one front spring 82 and one rear spring 84 respectively mounted therein. Such a structure of main springs can be referred to as an 1+1 structure.

Referring to FIG. 7, the front springs 82 mounted at the outer side of the cylinder 20 and the inner side of the inner stator 42 supported by the frame 52 form a structure which the piston 30 penetrates.

Here, the cylinder 20 having the front springs 82 mounted at the outer side is difficult to change the dimension of the inner diameter $\phi D$. This puts some limitation in designing the cylinder 20, thereby making it difficult to develop a model of a linear compressor.

FIG. 8 is a side cross sectional view schematically illustrating another structure of the conventional linear compressor. FIG. 9 is a perspective view illustrating a main spring assembly of FIG. 8.

In FIG. 8, in the linear compressor 1, a piston 30 is linearly reciprocated inside a cylinder 20 by a linear motor 40 in a hermetic shell 10 so as to suck, compress and discharge refrigerant. The linear motor 40 includes an inner stator 42, an outer stator 44, and a permanent magnet 46. The permanent magnet 46 is linearly reciprocated between the inner stator 42 and the outer stator 44 due to a mutual electromagnetic force. As the permanent magnet 46 is driven in a state where it is coupled to the piston 30, the piston 30 is linearly reciprocated inside the cylinder 20 to suck, compress and discharge refrigerant.

The linear compressor may have a configuration in which the cylinder 20 is fixed by the frame 52, or a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. A discharge cap 64 and a discharge muffler 66 are installed at the front of the discharge valve 62, and the discharge cap 64 and the discharge muffler 66 are fixed to the frame 52. A main spring assembly 33 is supported between one ends of the front springs 82 and rear springs 84, and a back cover 56 is supported on the other ends of the rear springs 84. The main spring assembly 33 may have a structure integrated and fixed by a first spring supporter and a second spring supporter. A structure in which four front main springs and four rear main springs are respectively arranged on outer side portions is foimed. The back muffler 75 is connected to the flange of the piston 30. As a suction muffler (not shown) is provided at an inner side of the back muffler 75, it may also be formed at an inner side of the piston 30.

In FIG. 9, the main spring assembly 33 includes a first spring supporter 32*a* and a second spring supporter 32*b* connected to the piston 30 so as to move integrally with the piston, front springs 82 mounted between the first spring supporter 32*a* and a stator cover (not shown), and rear springs 84 mounted between the second spring supporter 32*b* and a back cover (not shown). As four front springs 82 and four rear springs 84 are alternately arranged, a total of eight main springs are arranged.

As shown in FIGS. 7 and 8, there is provided a structure in which four main springs respectively at the front and rear are mounted at outer side portions, thus enabling a change in the inner diameter of the cylinder 20. As a result, this will be useful in developing various models. Such a structure for main springs can be referred to as a 4+4 structure.

As described above, in the conventional linear compressor, if one front spring and one rear spring are mounted, it is difficult to change the dimension of the inner diameter of the cylinder, thereby making it difficult to develop a model.

Additionally, if four main springs are mounted at the front and rear, respectively, production costs increase, and any problem making it difficult to manufacture and manage the linear compressor occurs.

Moreover, there is a large number of positional parameters to be controlled in order to maintain balance upon movement of the piston. Consequently, the manufacturing process becomes complicated and longer and the manufacturing cost is high.

DISCLOSURE OF INVENTION

Technical Problem

The present invention has been made in an effort to solve the above-mentioned problems occurring in the conventional art, and an object of the present invention is to provide a linear compressor which is provided with a back cover having a support portion for constraining the movement of a transverse displacement upon compression and expansion of a rear main spring.

Technical Solution

To achieve the above object, there is provided a linear compressor according to the present invention, comprising: a stationary member including a cylinder for providing a space for compressing a refrigerant; a movable member linearly reciprocating with respect to the stationary member, and including a piston for compressing the refrigerant inside the cylinder and a supporter piston connected to the piston and having a support portion extended in a radial direction of the piston; a plurality of front main springs positioned so as to be symmetrical with the center of the piston and the supporter piston, one ends of which being supported by the front surface of the support portion of the supporter piston and the other ends of which being supported by the stationary member; one rear main spring positioned at the opposite side of the piston, one end of which being supported by the supporter piston; and a back cover having a support portion for constraining the other end of the rear main spring from moving in a transverse direction.

Accordingly, it is possible to prevent the rear main spring from coming into unnecessary contact with the inside of the back cover while moving in the transverse direction, and avoid the generation of impurities caused by damage and abrasion of the rear main spring.

Additionally, in the linear compressor according to the present invention, the support portion for constraining the rear main spring is concentric with the center of the piston/cylinder.

Additionally, in the linear compressor according to the present invention, the support portion formed at the back cover comprises an inward constraining support portion for restricting the rear main spring from moving inward.

Additionally, in the linear compressor according to the present invention, the inward constraining support portion includes a bent part bent toward the cylinder.

Additionally, in the linear compressor according to the present invention, the bent part is an inclined bent part that is bent to be inclined inwardly.

Additionally, in the linear compressor according to the present invention, the bent part is a stepped bent part that is bent in a stepped manner.

Additionally, in the linear compressor according to the present invention, the support portion formed at the back cover comprises an outward constraining support portion for restricting the rear main spring from moving outward.

Additionally, in the linear compressor according to the present invention, the outward constraining support portion has a depressed part formed in the direction of a suction opening direction.

Additionally, in the linear compressor according to the present invention, the outward constraining support portion has a convex part formed in the direction of the cylinder.

Additionally, in the linear compressor according to the present invention, the outward constraining support portion is formed by cutting out some part along the edge supporting the other end of the rear main spring and bending the same upwardly.

It is another object of the present invention to provide a linear compressor which provides the same mounting distance as the stiffness of one rear main spring and the stiffness of two front main springs coincide with each other, and enables it to change the inner diameter of a cylinder as the front main springs are mounted at an outer side portion of the cylinder.

Accordingly, there is provided a linear compressor according to the present invention, comprising: a stationary member including a cylinder for providing a space for compressing a refrigerant; a movable member linearly reciprocating with respect to the stationary member, and including a piston for compressing the refrigerant inside the cylinder and a supporter piston fixed to the piston and having a support portion extended in a radial direction of the piston; two front main springs symmetrical with respect to the center of the piston and the supporter piston, one ends of which being supported by the front surface of the support portion of the supporter piston and the other ends of which being supported by the stationary member; and one rear main spring positioned at the opposite side of the piston and having a stiffness approximately the same as the sum of the stiffness of the two front main springs so as to enable the movable member to be moved in a resonance condition, one end of which being supported by the supporter piston. By this configuration, the number of front and rear main spring applying a force to enable the movable member to be moved in the resonance condition is reduced, thereby cutting down the manufacturing costs of the linear compressor.

In another aspect of the present invention, the mounting distances of the front main springs and the rear main spring are approximately the same. Here, the mounting distances of the front main springs and the rear main spring indicate the length of the front main springs and the length of the rear main spring when the front main springs and the rear main spring are kept in an equilibrium state in a state that the movable member is not moved.

In another aspect of the present invention, the center of the rear main springs coincides with the center of the piston. By this configuration, the movement direction of the piston and the direction in which the rear main spring applies a force coincide with each other, thereby preventing abrasion of the piston and improving the efficiency of the linear compressor.

In another aspect of the present invention, the other end of the front main springs is installed at the outer side of the cylinder. That is, the other end of the front main springs is supported not by the cylinder but by a stator cover to be described later. By this configuration, the dimension of the inner diameter of the cylinder can be changed.

Accordingly, the compression capability of the compressor can be changed by changing only the sizes of the cylinder and the piston without much changing the overall configuration of the compressor.

In another aspect of the present invention, the stationary member further comprises a stator cover for supporting the other end of the front main springs.

In another aspect of the present invention, the front main springs are provided in a pair at longitudinally and laterally symmetrical positions.

In another aspect of the present invention, the front main springs and the rear main spring have a natural frequency approximately coinciding with the resonant operation frequency of the piston.

In another aspect of the present invention, the stationary member further comprises a stator cover for supporting the other end of the front main springs.

In another aspect of the present invention, the linear compressor further comprises a suction muffler positioned inside the rear main spring and communicating with the piston.

In another aspect of the present invention, the suction muffler is fastened to the supporter piston by bolts.

In another aspect of the present invention, of the supporter piston, the portion contacting with the front main springs is surface-treated.

In another aspect of the present invention, of the supporter piston, the portion contacting the front main springs is surface-treated by any one of NIP coating and anodizing treatment.

Advantageous Effects

The thus-constructed linear compressor according to the present invention has the advantage of preventing the rear main spring from coming into unnecessary contact with the inside of the back cover and avoiding the generation of impurities caused by damage and abrasion of the rear main spring by having a back cover with a support portion for constraining the rear main spring from moving in a transverse direction.

MODE FOR THE INVENTION

Hereinafter, an embodiment of the present invention will be described in detail with reference to the accompanying drawings.

Figure 10:
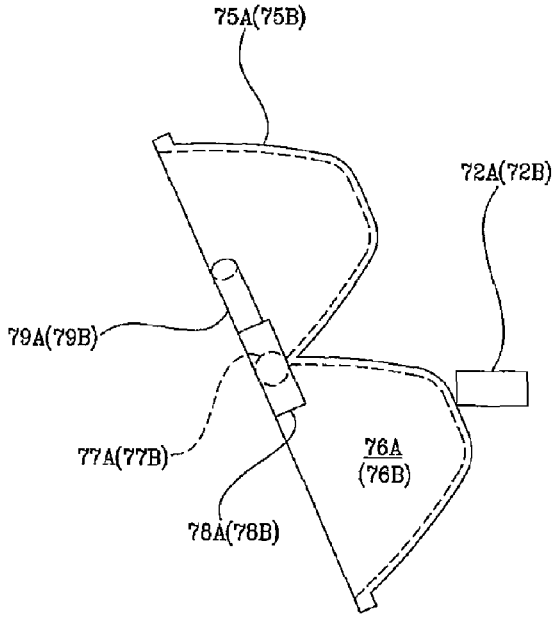
FIG. 10 is a side cross sectional view illustrating a linear compressor according to the present invention.
Figure 11:
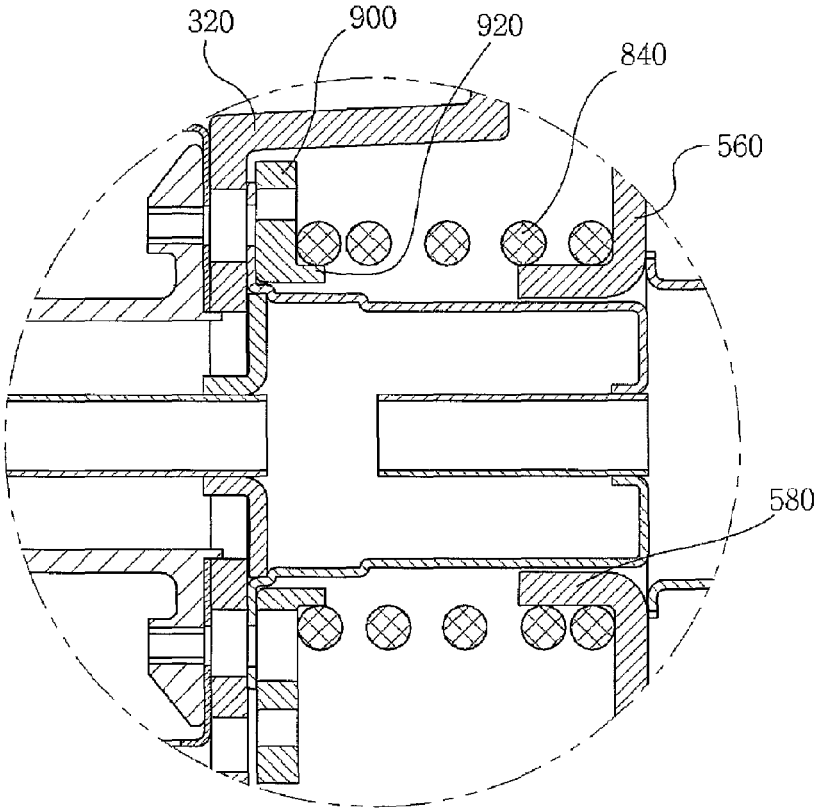
FIG. 11 is a side cross sectional view enlargedly illustrating a portion B of FIG. 10.

FIG. 10 is a side cross sectional view illustrating a linear compressor according to the present invention. FIG. 11 is a side cross sectional view enlargedly illustrating a portion B of FIG. 10.

Referring to FIG. 10, a piston 300 is linearly reciprocated inside a cylinder 200 by a linear motor 400 in a hermetic shell 110 so as to suck, compress and discharge refrigerant. The linear motor 400 includes an inner stator 420, an outer stator 440, and a permanent magnet 460. The permanent magnet 460 is linearly reciprocated between the inner stator 420 and the outer stator 440 due to a mutual electromagnetic force. As the permanent magnet 460 is driven in a state where it is coupled to the piston 300, the piston 300 is linearly reciprocated inside the cylinder 200 to suck, compress and discharge refrigerant.

The linear compressor 100 further includes a frame 520, a stator cover 540, and a back Cover 560. The linear compressor may have a configuration in which the cylinder 200 is fixed by the frame 520, or a configuration in which the cylinder 200 and the frame 520 are integrally formed. At the front of the cylinder 200, a discharge valve 620 is elastically supported by an elastic member, and selectively opened and closed according to the pressure of the refrigerant inside the cylinder 200. A discharge cap 640 and a discharge muffler 660 are installed at the front of the discharge valve 620, and the discharge cap 640 and the discharge muffler 660 are fixed to the frame 520. One end of the inner stator 420 or outer stator 440 as well is supported by the frame 520, and an O-ring or the like of the inner stator 420 is supported by a separate member or a projection formed on the cylinder 200, and the other end of the outer stator 440 is supported by the stator cover 540. The back cover 560 is installed on the stator cover 540, and a suction muffler 700 is positioned between the back cover 560 and the stator cover 540.

Further, a supporter piston 320 is coupled to the rear of the piston 300. Main springs 800 whose natural frequency is adjusted are installed at the supporter piston 320 so that the piston 300 can be resonantly moved. The main springs 800 are divided into front main springs 820 whose both ends are supported by the supporter piston 320 and the stator cover 540 and a rear main spring 840 whose both ends are supported by the supporter piston 320 and the back cover 560.

Here, the center of the rear main spring 840 coincides with the center of the piston 300. The suction muffler 700 is positioned inside the rear main spring 840, and connected to at least one of the piston 300 and the supporter piston 320 to introduce a refrigerant into the piston 300.

Further, the supporter piston 320 and the spring guide 900 have corresponding guide holes for guiding the supporter piston 320 and the spring guide 900 to be coupled to each other so that the centers of the piston 300 and the rear main spring 840 may coincide with each other.

FIG. 11 enlargedly illustrating a portion B of FIG. 10 depicts in detail a member for supporting the rear main spring 840 inside the back cover 560 of the present invention. Both ends of the rear main spring 840 are supported by the spring guide 900 and the back cover 560, and stably mounted. Here, the back cover 560 has a bent part forming a skirt portion 580.

Here, the spring guide 900 is positioned between the supporter piston 320 and the rear main spring 840, and guides such that the center of the rear main spring 840 and the center of the piston 300 may coincide with each other. In addition, the spring guide 900 has a stepped part 920 to which one end of the rear main spring 840 is fitted. Further, of the spring guide 900, at least the portion contacting with the rear main spring 840 has a larger hardness than the hardness of the rear main spring 840.

Figure 12:
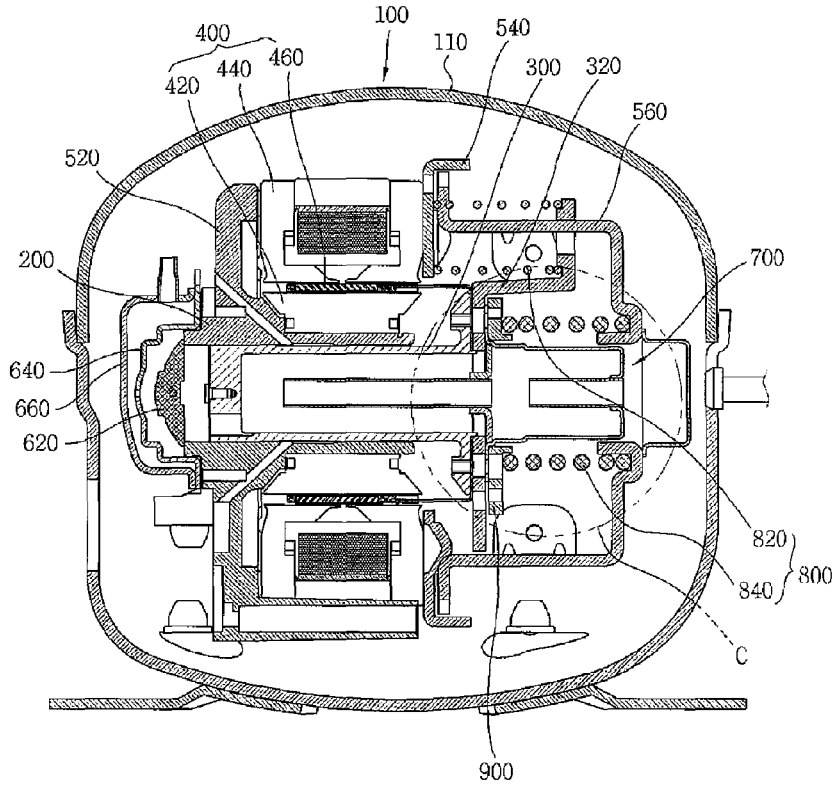
FIG. 12 is a side cross sectional enlarged view schematically illustrating a structure of the rear main spring and back cover of the linear compressor according to the present invention.

FIG. 12 is a side cross sectional view showing another embodiment of the back cover 560 as illustrated in FIGS. 10 and 11.

Like in FIG. 11, the spring guide 900 is positioned between the supporter piston 320 and the rear main spring 840, and guides such that the center of the rear main spring 840 and the center of the piston 300 may coincide with each other. In addition, the spring guide 900 has a stepped part 920 to which one end of the rear main spring 840 is fitted. Further, of the spring guide 900, at least the portion contacting with the rear main spring 840 has a larger hardness than the hardness of the rear main spring 840.

Figure 13:
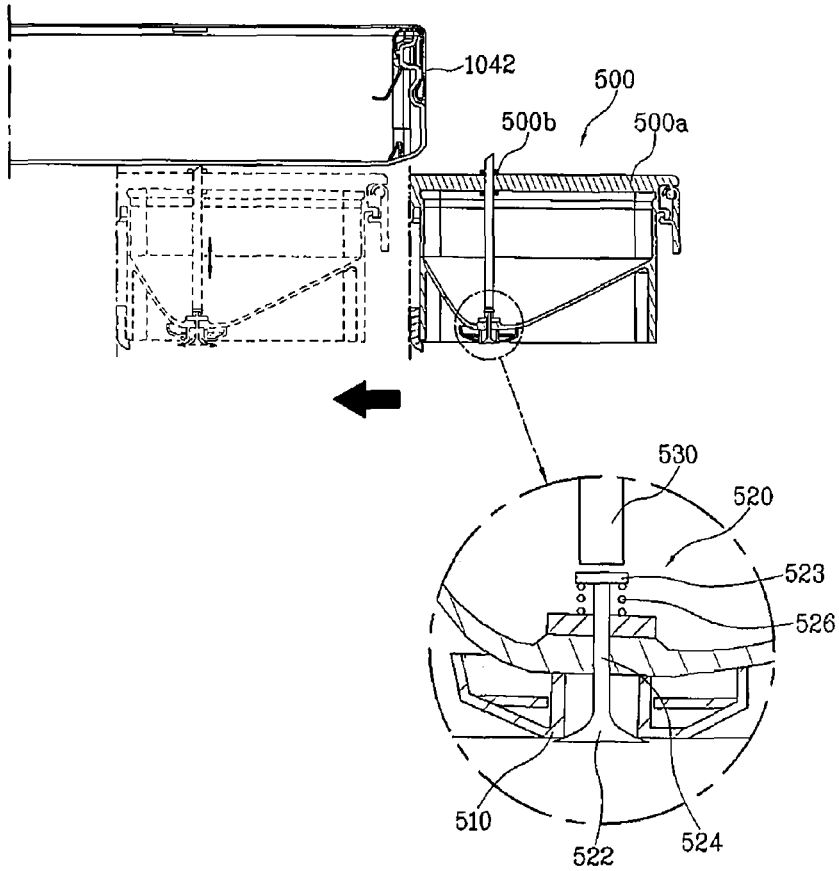
FIG. 13 is a side cross sectional view schematically illustrating an inward constraining support portion including a bent part that is bent to be inclined inwardly on the back cover of the linear compressor according to the present invention.
Figure 14:
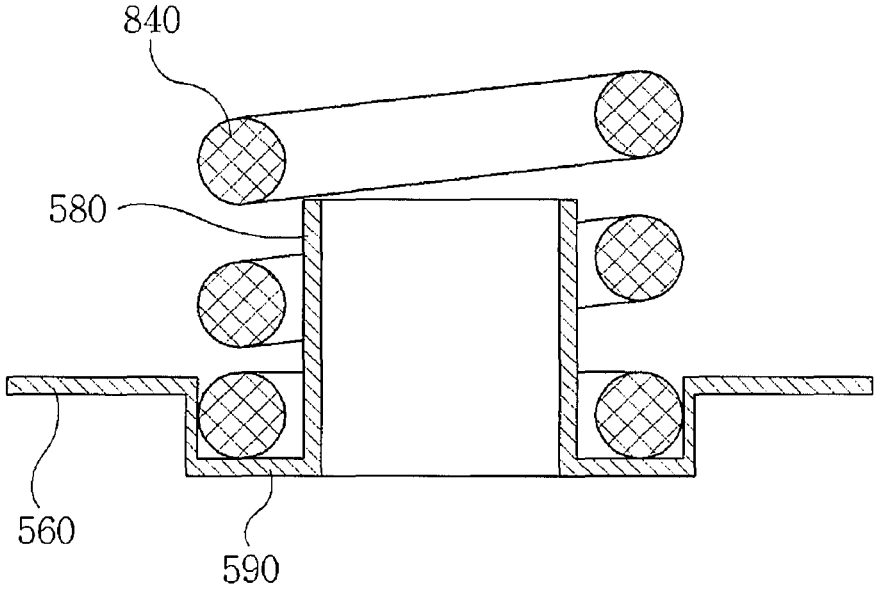
FIG. 14 is a side cross sectional view schematically illustrating an inward constraining support portion including a stepped bent part that is bent in a stepped manner on the back cover of the linear compressor according to the present invention.

FIG. 13 is a side cross sectional view schematically illustrating an inward constraining support portion including a bent part that is bent to be inclined inwardly from the back cover of the linear compressor according to the present invention. FIG. 14 is a side cross sectional view schematically illustrating an inward constraining support portion including a stepped bent part that is bent in a stepped manner from the back cover of the linear compressor according to the present invention.

FIG. 12 is an illustration of the depressed part 590 that is depressed in the direction of the suction opening on the back cover 560, which is illustrated to intuitively understand the outward constraining support portion for restricting the rear main spring 840 form moving outward. That is to say, as the depressed part 590 is provided, the outer side of the rear main spring 840 is supported thereon. Further, this figure is an illustration of the bent part that is bent toward the cylinder so as to form an inward constraining support portion for restricting the rear main spring 840 form moving inward.

FIG. 13 is an illustration of the bent part that is bent to be inclined inward on the back cover 560 so as to form an inward constraining support portion for restricting the rear main spring 840. As well as the outer side of the rear main spring 840 is supported on the depressed part 590 depressed in the direction of the suction opening, a predetermined gap can be easily formed between the skirt portion 580 of the bent part and an inner side portion of the rear main spring 840. The predetermined gap thus-formed can prevent interference by the skirt portion 580 of the back cover 560 due to a transverse displacement generated upon compression and expansion of the rear main spring 840. Accordingly, it is possible to prevent impurity generation and noise caused by damage and abrasion of the rear main spring 840 which is induced by interface occurring at the back cover 560 portion which the rear main spring 840 is supported.

Of course, the inwardly inclined bent part can be designed not to hit the suction muffler 700.

Hereinafter, a description of the rear main spring 840 will be omitted, and various embodiments capable of restricting the rear main spring 840 from moving in a transverse direction in the structure of the back cover 560 will be discussed.

FIG. 14 is an illustration of the stepped bent part that is bent in a stepped manner on the back cover 560 so as to form an inward constraining support portion for restricting the rear main spring 840. As well as the outer side of the rear main spring 840 is supported on the depressed part 590 depressed in the direction of the suction opening, a predetermined gap can be easily formed between the skirt portion 580 of the bent part and an inner side portion of the rear main spring 840. As shown in FIG. 13, it is possible to prevent interference by the skirt portion 580 of the back cover 560 due to a transverse displacement upon compression and expression of the rear main spring 840.

Of course, the stepped bent part can be designed not to hit the suction muffler 700.

Figure 15:
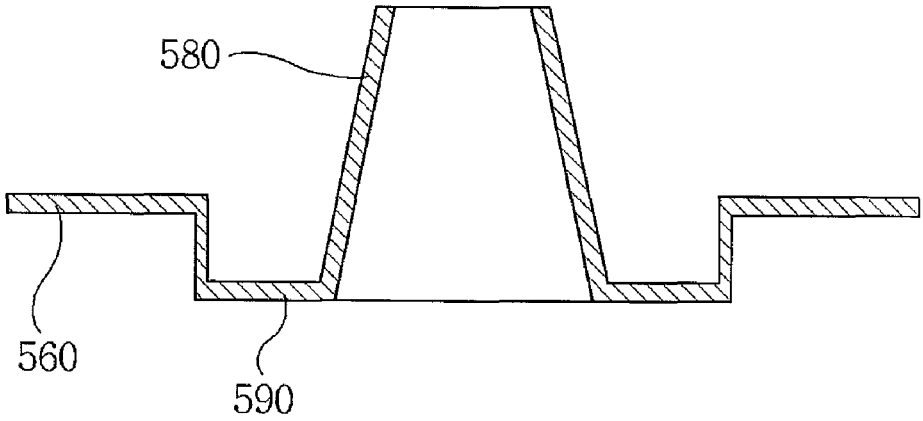
FIG. 15 is a side cross sectional view schematically illustrating an inward constraining support portion including a convex part that is made convex on the back cover of the linear compressor according to the present invention.
Figure 16:
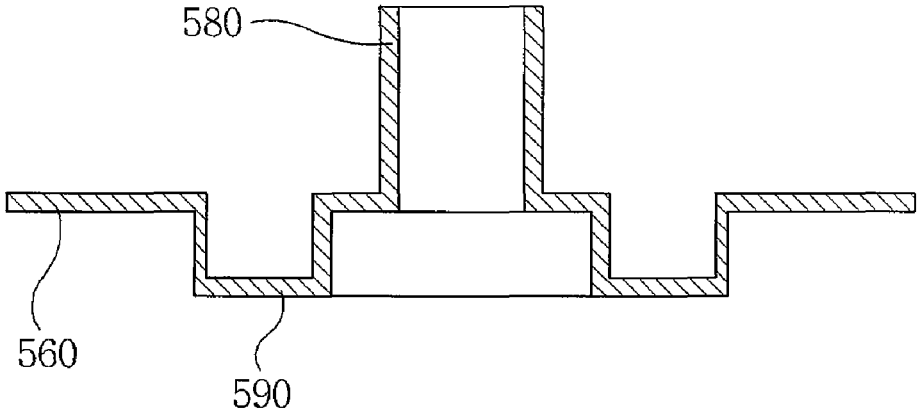
FIGS. 16A-16B are side cross sectional views schematically illustrating an inward constraining support portion cut out at some part along the circumference supporting the other end of the rear main spring on the back cover of the linear compressor according to the present invention.

FIG. 15 is a side cross sectional view schematically illustrating an inward constraining support portion including a convex part that is made convex on the back cover of the linear compressor according to the present invention. FIGS. 16A-16B are side cross sectional views schematically illustrating an inward constraining support portion cut at some part along the circumference supporting the other end of the rear main spring on the back cover of the linear compressor according to the present invention.

FIG. 15 is an illustration of the depressed part that is depressed on the back cover 560 in the direction of the cylinder so as to form an outward constraining support portion for restriction the rear main spring 840 from moving outward. This is an embodiment in which a convex part is formed on the back cover 560 in the direction of the cylinder so as to easily realize the design for supporting the outer side of the rear main spring 840 by having a depressed part 590 depressed in the direction of the suction opening in FIGS. 11 to 17.

FIGS.16A-16B are an illustration of the cutting out of some part on the back cover 560 along the circumference supporting the other end of the rear main spring 840 so as to form an outward constraining support portion for restricting the rear main spring 840 from moving outward. First, the side cross sectional view of the back cover 560 shown in the upper part shows that the outward constraining portion 592 is formed by lifting a cutout part 594 cut out from some part of the back cover 560. Further, the lower part illustrates in a plan view the cutout part 594 formed by cutting out some part of the back cover so as to form the outward constraining support portion 592. This is another embodiment which can substitute the design having a depressed part formed in the direction of the cylinder in FIG. 15.

Figure 17:
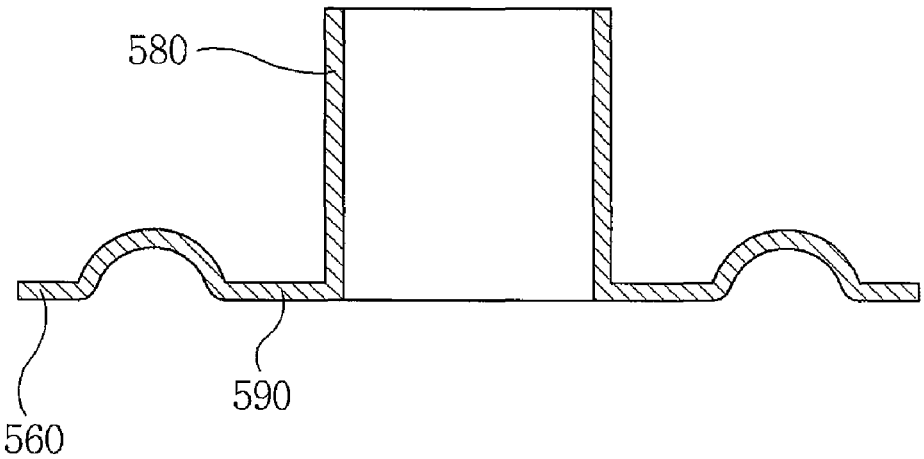
FIG. 17 is a view illustrating the back cover of the linear compressor according to the present invention.

FIG. 17 is a view illustrating the back cover of the linear compressor according to the present invention. Here, the right part is a side cross sectional view taken along line D-D of the back cover and suction guide as shown on the left part.

As illustrated therein, there is shown an embodiment in which the suction guide 750 is positioned at the center portion of the back cover 560, and the back cover 560 has a part depressed in the direction of the suction opening as shown in previous embodiments.

In the above-described structure of the back cover 560, the support portion constraining the rear main spring 840 is concentric with the center of the piston 300/cylinder 200. Such a structure makes it easier to make the centers coincide with each other, thereby enabling the rear main spring 840 to move precisely. Further, preferred embodiments capable of forming a support portion for constraining the rear main spring 840 from moving in a transverse direction are possible.

Here, the formation of a support portion for constraining the rear main spring 840 from moving in a transverse direction in the structure of the back cover 560 can prevent impurity generation and noise caused by damage and abrasion of the rear main spring 840.

As above, the linear compressor according to the present invention can reduce parts production costs by decreasing the number of main springs and provide a structure of the back cover having a support portion for constraining the rear main spring from moving in a transverse direction.

Figure 18:
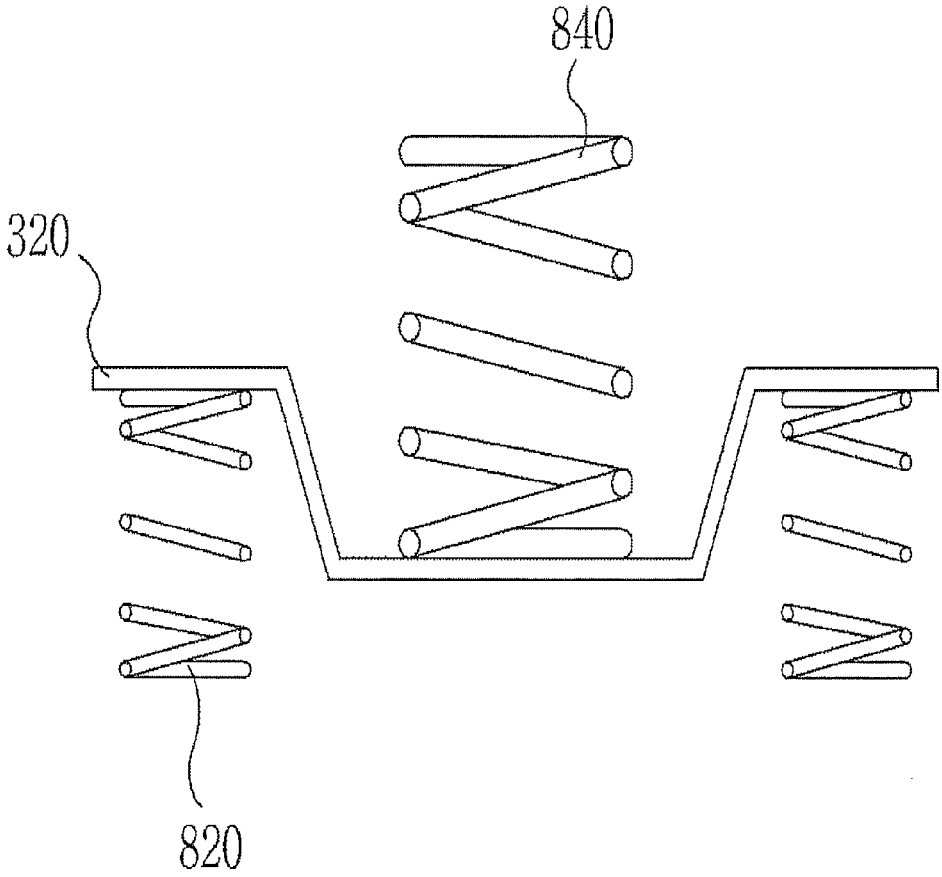
FIG. 18 is a side cross sectional view illustrating a main spring part of the linear compressor according to the present invention.
Figure 19:
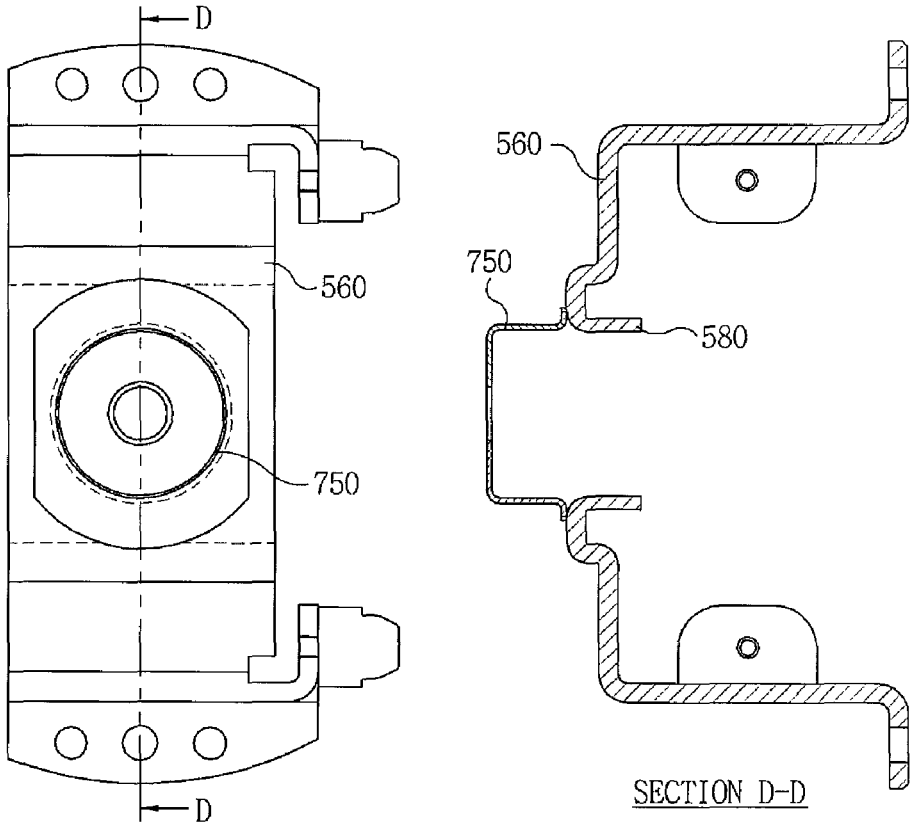
FIG. 19 is a view showing a stiffness relationship of the main springs according to the present invention.
Figure 20:
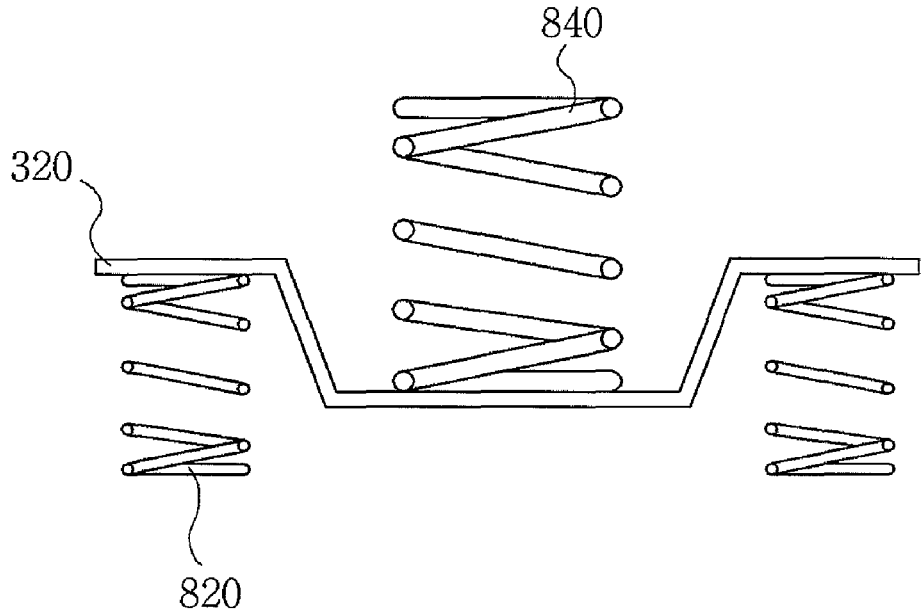
Figure 21:
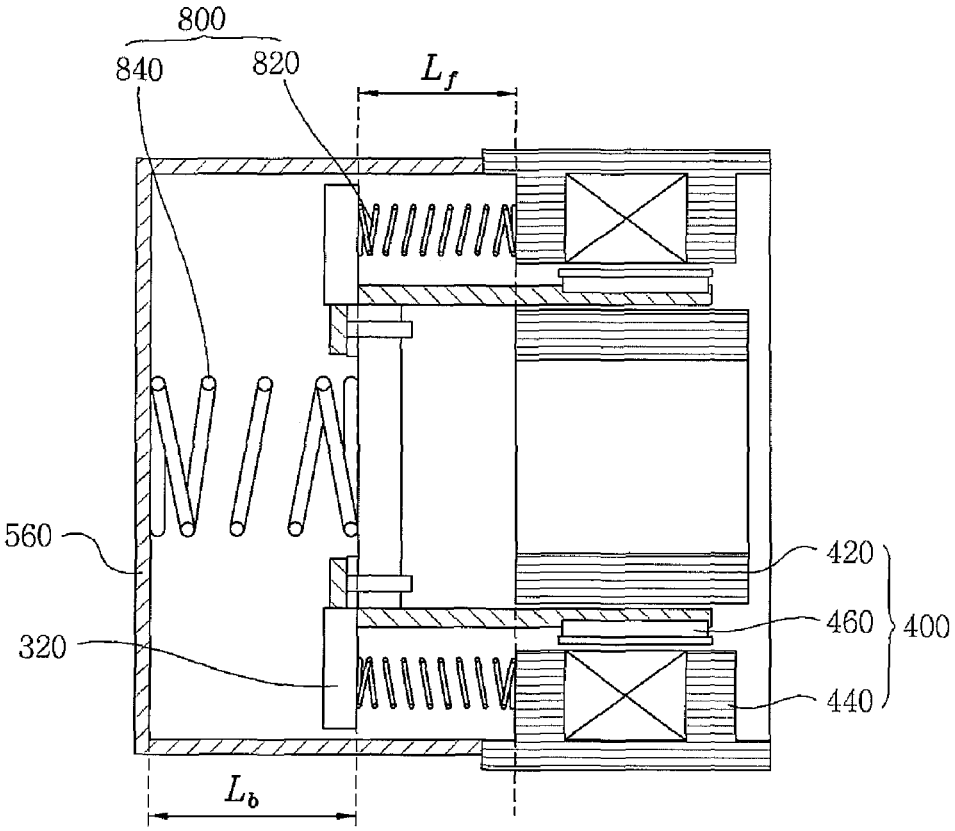

FIG. 18 is a side cross sectional view illustrating a main spring part of the linear compressor according to the present invention. FIG. 19 is a view showing a stiffness relationship of the main springs according to the present invention.

In FIG. 10, at the rear of the piston 300, a suction muffler 700 is provided so as to reduce noise during the suction of refrigerant as the refrigerant is introduced into the piston through the suction muffler 700. At this moment, the outer diameter of some part of the suction muffler 700 engages with the inner diameter of the rear main spring 840.

The inside of the piston 300 is hollowed out to introduce the refrigerant introduced through the suction muffler 700 into a compression space P formed between the cylinder 200 and the piston 300 and compress it. A valve (not shown) is installed at the front end of the piston 300. The valve (not shown) is opened to introduce the refrigerant into the compression space from the piston 300, and closes the front end of the piston 300 so as to avoid the refrigerant from being introduced again into the piston from the compression space.

If the refrigerant is compressed by the piston 300 in the compression space at a pressure higher than a predetermined level, a discharge valve 620 positioned on the front end of the cylinder 200 is opened. The discharge valve 620 is installed so as to be elastically supported by a spiral discharge valve spring inside a discharge cap 640 fixed to one end of the cylinder 200. The compressed refrigerant of high pressure is discharged into a discharge muffler 660 through a hole formed on the discharge cap 640,and then discharged out of the linear compressor 200 through a loop pipe(not shown) thus to circulate the refrigerating cycle.

Each of the parts of the above-described linear compressor 100 is supported in an assembled state by front support springs (not shown) and a rear support spring (not shown), and is spaced apart from the bottom of the shell 110. Since the parts are not in direct contact with the bottom of the shell 110, vibrations generated from each of the parts are not directly transmitted to the shell 110. Therefore, noise generated from the vibration transmitted to the outside of the shell 110 and the vibration of the shell 110 can be reduced.

The supporter piston 320 is coupled to the rear of the piston 300, and receives a force from the main springs 820 and 840 and transmits it to the piston 300 so that the piston 300 can linearly reciprocate under a resonance condition.

The supporter piston 320 is installed such that its center is consistent with the center of the piston 300. Preferably, a step is formed on the rear end of the piston 300 so as to easily make the centers of the supporter piston 320 and the piston 300 coincide with each other.

Regarding the main springs applying a restoration force to the supporter piston 320 to operate the piston 300 coupled to the supporter piston 320 under the resonance condition, the number of the front main springs 820 is decreased to two and the number of the rear main spring 840 is decreased to one, thereby decreasing the stiffness of the main springs on the whole. Further, if the stiffness of the front main springs 820 and the rear main spring 840 is decreased, respectively, the production cost of the main springs can be cut down.

Figure 1:
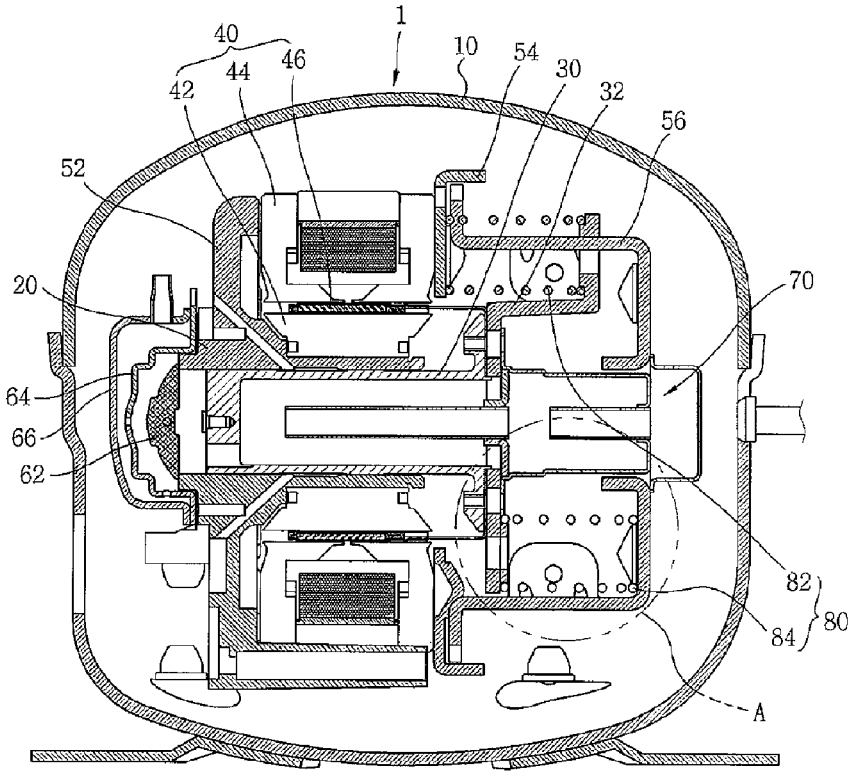
FIG. 1 is a view illustrating a conventional linear compressor.
Figure 2:
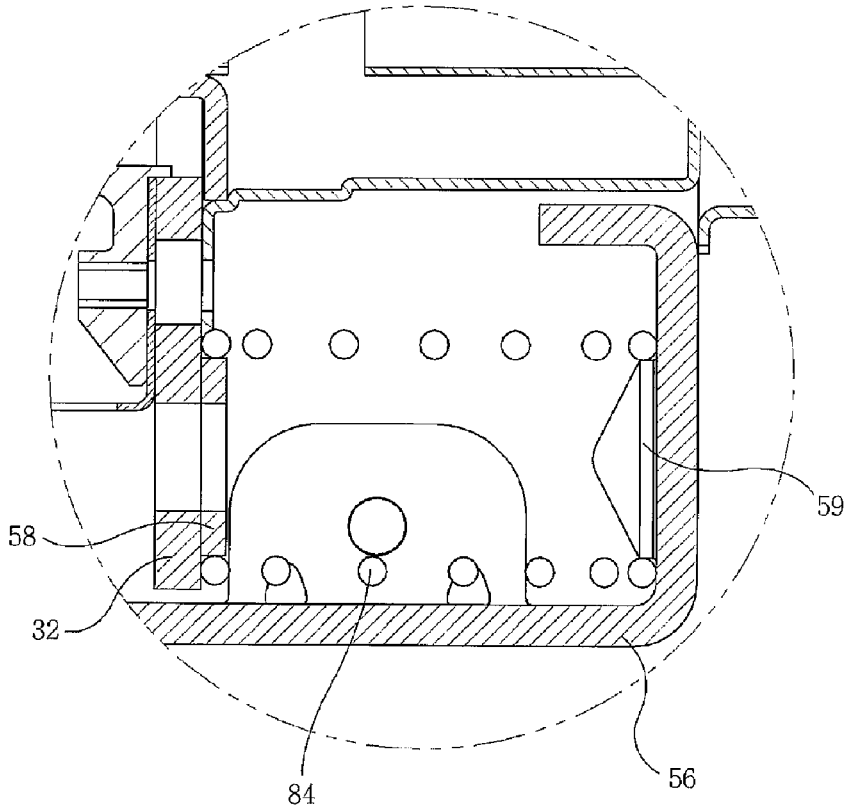
FIG. 2 is a side cross sectional view enlargedly illustrating a portion A of FIG. 1.
Figure 3:
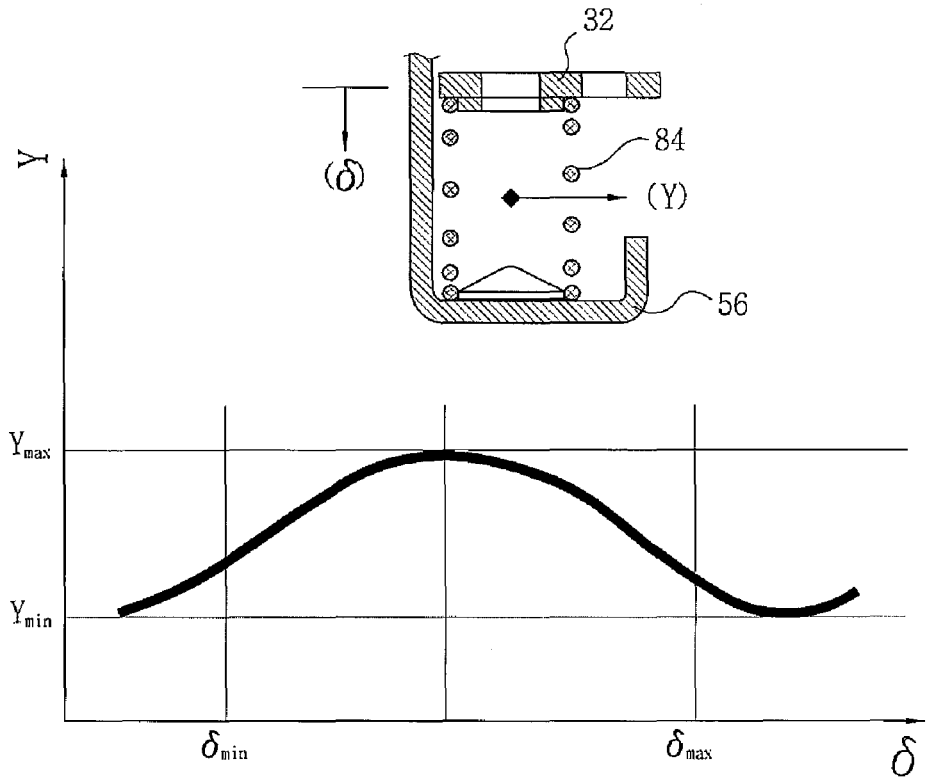
FIG. 3 is a graph illustrating a horizontal displacement amount of a rear spring in accordance with the amount of compression in the conventional linear compressor.
Figure 4:
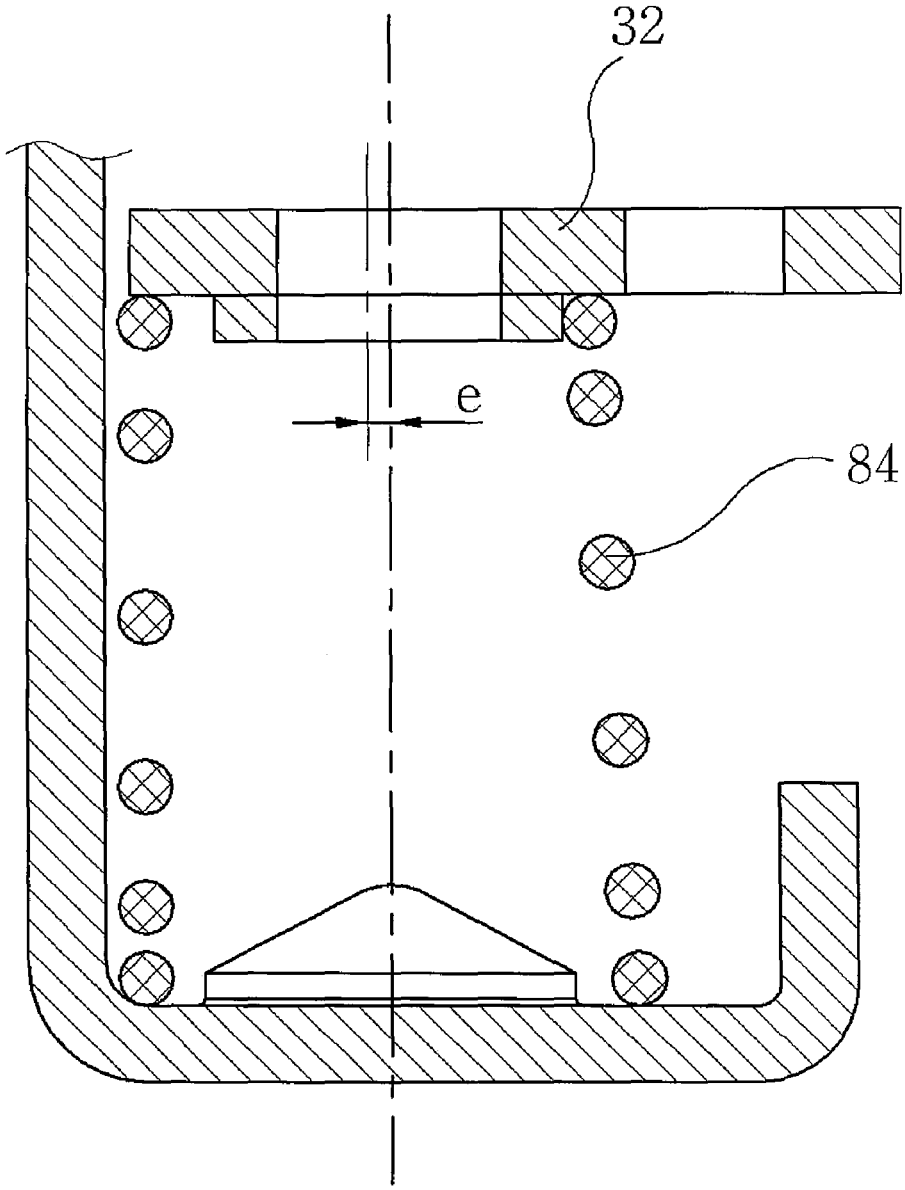
FIG. 4 is a side view schematically illustrating a case where a gap between the rear spring and the back cover support portion is made larger in the conventional art.
Figure 5:
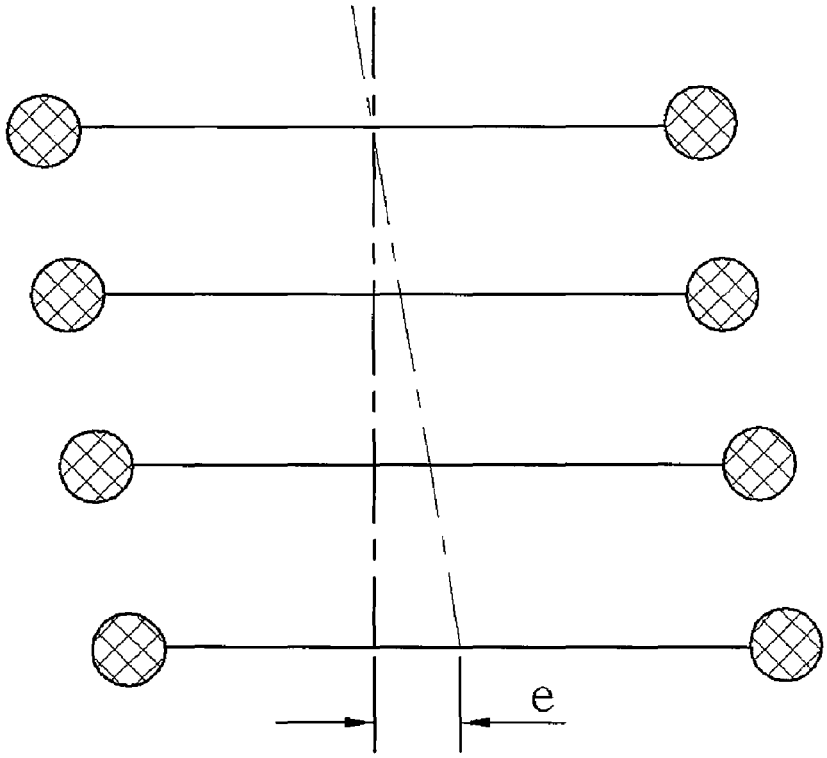
FIG. 5 is a side view schematically illustrating the shape of a real object in accordance with an eccentricity (e) generated from the rear spring in the conventional art.
Figure 6:
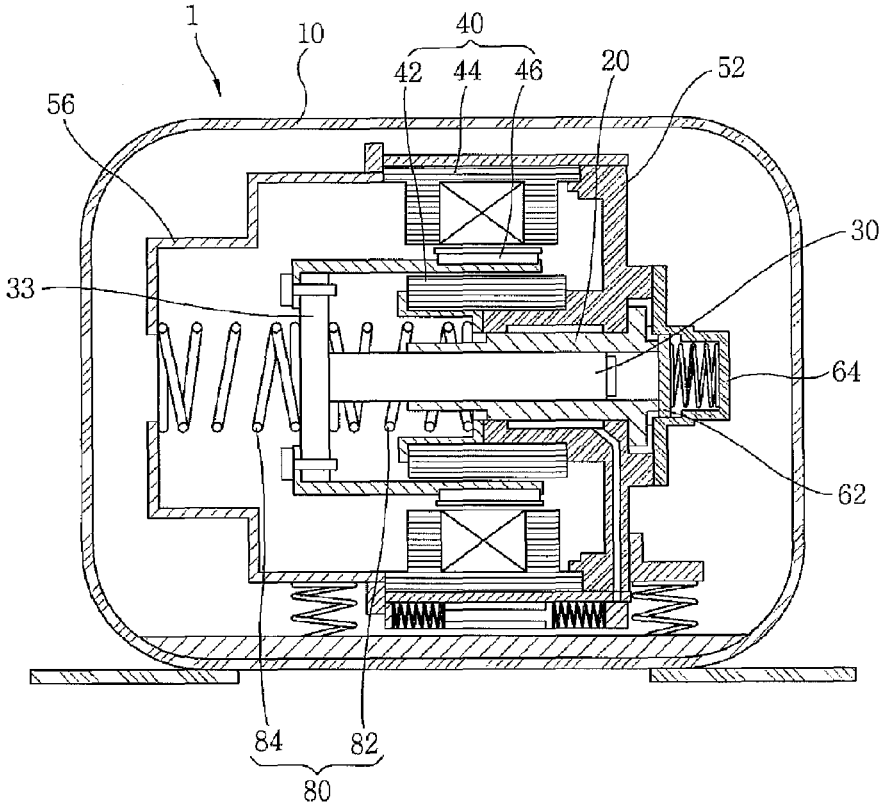
FIG. 6 is a side cross sectional view schematically illustrating a conventional linear compressor.
Figure 7:
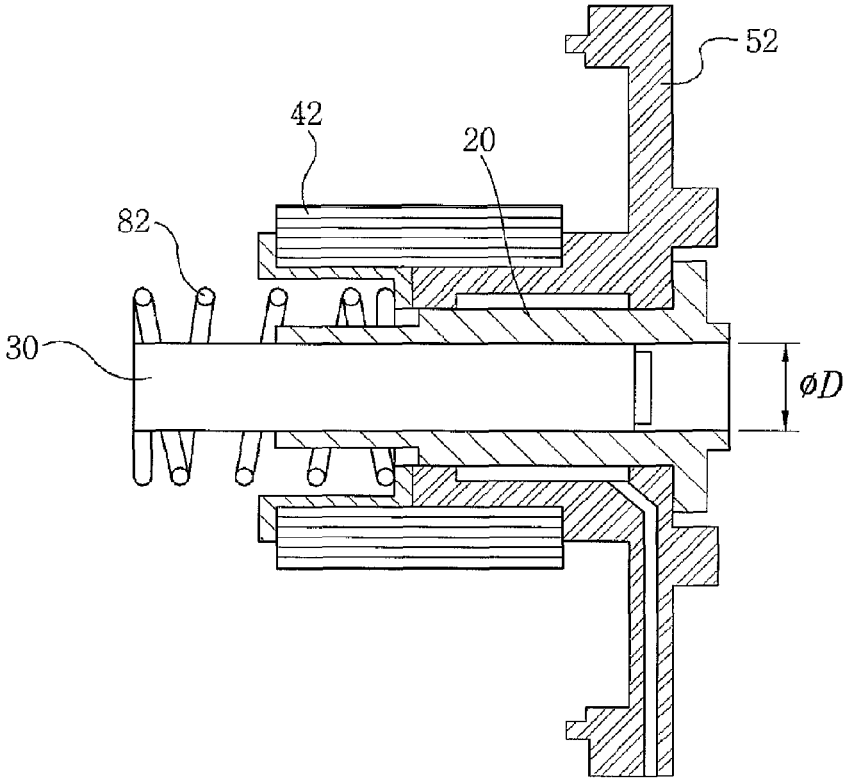
FIG. 7 is a side cross sectional view enlargedly illustrating a front main spring part of FIG. 6.

At this time, if the stiffness of the front main springs 820 and the rear main spring 840 becomes smaller, the mass of the driving unit including the piston 300, supporter piston 320, and permanent magnet 460 should be smaller to thus drive the driving unit under a resonance condition. Therefore, the supporter piston 320 is made of a non ironbased metal having a lower density than that of an iron-based metal, rather than being made of an iron-based metal. As a result, the mass of the driving unit can be reduced, and accordingly can be driven at a resonance frequency according to the decreased stiffness of the front main springs 820 and the rear main spring 840. For example, if the supporter piston 320 is made of a nonmagnetic metal, such as aluminum, even if the piston 300 (shown in FIG. 4) is made of a metal, the supporter piston 320 has no effect from the permanent magnet 460. Therefore, the piston 300 and the supporter piston 320 can be coupled to each other more easily.

If the supporter piston 320 is made of a non iron-based metal having a low density, this offers the advantage that the resonance condition is satisfied and the supporter piston 320 can be easily coupled to the piston 300. However, the portion contacting with the front main springs 820 may be easily abraded by a friction with the front main springs 820 during driving. Here, the front main springs 320 may be provided in a pair at longitudinally and laterally symmetrical positions according to the position of the supporter piston 320. When the supporter piston 320 is abraded, abraded debris may damage the parts existing on the refrigerating cycle while floating in the refrigerant and circulating the refrigerating cycle.

Therefore, surface treatment is performed on the portion where the supporter piston 320 and the front main springs 820 are in contact with each other. By carrying out NIP coating or anodizing treatment, the surface hardness of the portion where the supporter piston 320 and the front main springs 820 are in contact with each other is made larger at least than the hardness of the front main springs 820. By this construction, it is possible to prevent the generation of debris by the supporter piston 320 being abraded by the front main springs 820.

Further, the suction muffler 700 is mounted to the rear of the supporter piston 320, and the refrigerant to be compressed is sucked into the piston 300 in a state in which noise is reduced by means of the suction muffler 700.

Preferably, there are provided a mounting portion and a guide groove for preventing from the supporter piston 320 and the suction muffler 700 from longitudinally or laterally deviating from each other. As the center of the suction muffler 700 and the center of the supporter piston 320 coincide with each other without any deviation therebetween, the center of the piston 300, which coincides with the center of the supporter piston 320, also coincides with the center of the suction muffler 700.

Further, the rear main spring 840 is mounted to the outer diameter of the suction muffler 700. The inner diameter of the rear main spring 840 engages with the outer diameter of the suction muffler 700. Therefore, the center of the suction muffler 700 coincides with the center of the rear main spring 840.

Accordingly, it is possible for the piston 300 to linearly reciprocate while maintaining a resonance condition with the rear main spring 840, the number of which is decreased to one, and the front main springs 820, the number and stiffness of which are decreased according to the decrease in stiffness caused by the decrease in the number of the rear main spring 840. By this construction, the production costs of the main springs can be cut down since the number of the main springs is decreased and the stiffness is decreased.

FIG. 18 is a view illustrating a structure in which two front main springs 820 and one rear main spring 840 of the present invention are supported by the supporter piston 320. The structure of the main springs of the present invention is more useful than the structure using four front main springs and four rear main springs in terms of cost reduction and the manufacture and management depending on quantity. Also, even when compared with the structure using one front main spring and one rear main spring, the inner diameter of the cylinder can be changed by structurally mounting the front main springs outside the cylinder, thereby enabling the development of various models.

Figure 8:
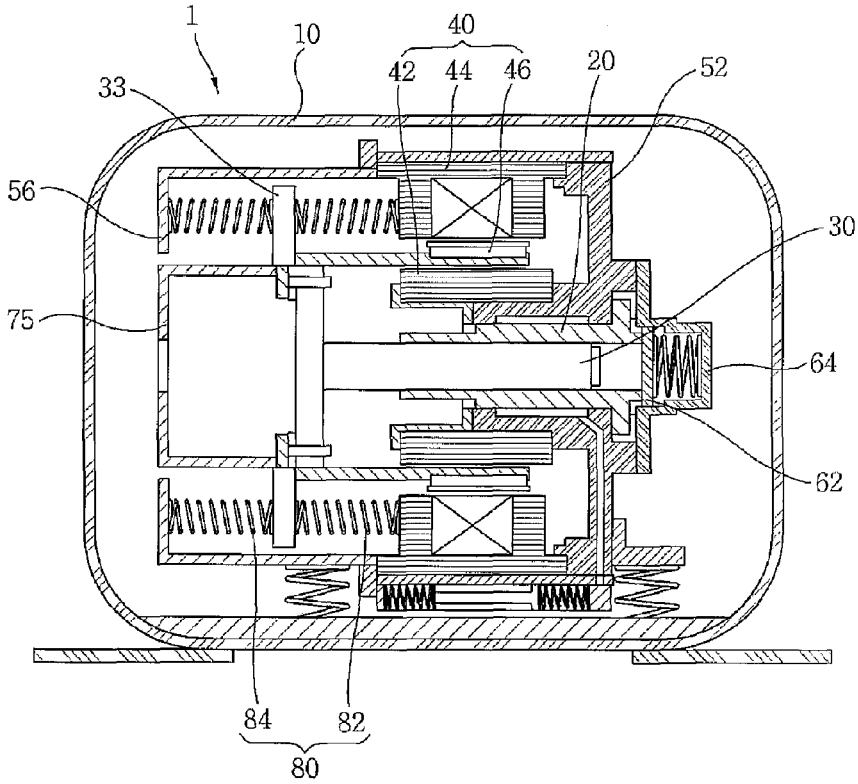
FIG. 8 is a side cross sectional view schematically illustrating another structure of the conventional linear compressor
Figure 9:
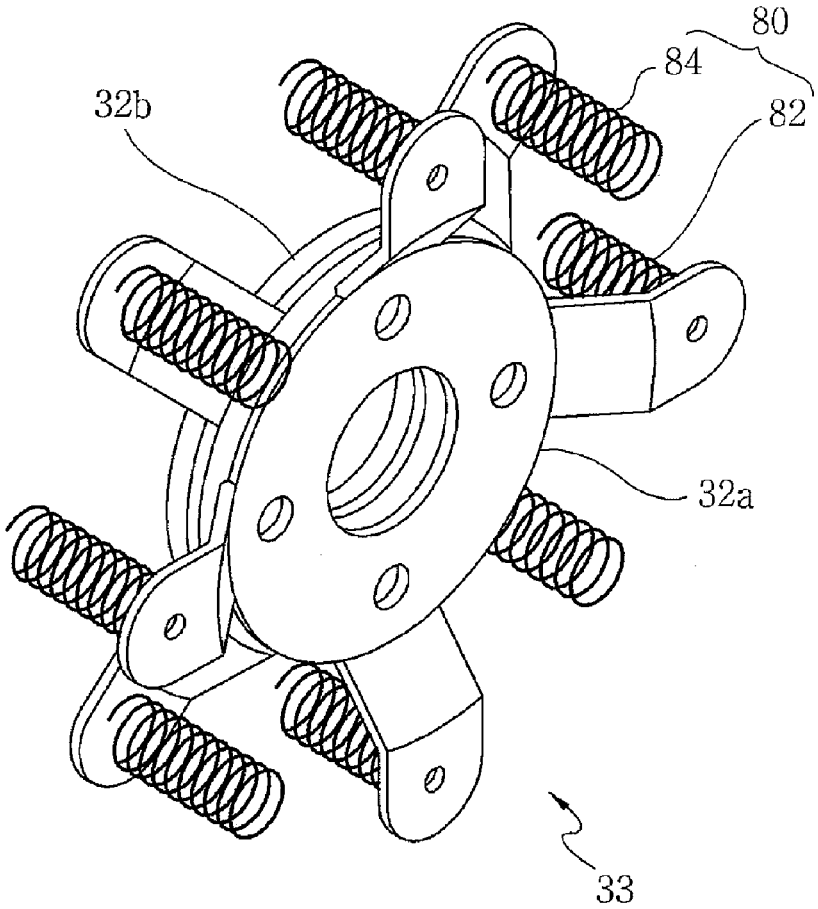
FIG. 9 is a perspective view illustrating a main spring assembly of FIG. 8.

In FIG. 19, the stiffness and mounting distance conditions of the front main springs 820 and rear main spring 840 of the present invention can be checked. The piston 300 (shown in FIG.8) linearly reciprocates by the linear motor. Also, two front main spring 820 and one rear main spring 840 are installed, respectively, at the front and rear of the supporter piston 320 connected to the piston 300. The front main springs 820 and the rear main spring 840 are compressed to pulled with linear reciprocation of the piston 300. As a result, restoration force caused by the stiffness of the front main springs 820 and rear main spring 840 is transmitted to the piston 300. It is preferable to determine the stiffness of the front main springs 820 and rear main spring 840 enough to allow the driving unit including the piston 300 to move in a resonance condition. This because when the front main springs 820 and the rear main spring 840 have stiffness enough to allow the piston 300 to move in a resonance condition, power supplied to the linear motor driving the piston 300 can be most minimized.

The sum of the stiffness coefficients Kf of the front main springs 820 are approximately the same as the stiffness coefficient Kb of the one rear main spring 840 installed at the rear side. This is applied to a case where the stiffness coefficients Kf of the front main springs 820 are slightly changed by a tolerance that may be generated upon manufacture and installation, as well as a case where the stiffness coefficients Kf of the front main springs 820 are completely consistent with each other.

Further, the mounting distances of the front main springs 820 and rear main spring 840 are approximately equal. Here, the mounting distances of the front main springs 820 and rear main spring 840 refer to the length of the front main springs 820 and the length of the rear main spring 840 when the front main springs 820 and the rear main spring 840 are in an equilibrium state in a state that the operating member is not in operation. The mounting distance Lf of the front main springs 820 and the mounting distance Lb of the rear main spring 840 are approximately equal to each other, which is also applied to a case where the mounting distances Lf and Lb are slightly changed by a tolerance upon manufacture and installation. Since the mounting distance Lf of the front main springs 820 and the mounting distance Lb of the rear main spring 840 are equal, a stroke distance of the piston 300 (shown in FIG. 8) can be set as long as possible, and it is easy to set a stroke distance.

As a result, the stiffness coefficient Kf of the front main springs is approximately ½ times the stiffness coefficient Kb of the rear main springs, or the stiffness coefficient Kb of the rear main spring is approximately two times the stiffness coefficient Kf of the front main springs.

In this way, the linear compressor according to the present invention is useful in terms of the cost reduction of main springs and the manufacture and management depending on quantity by having two front main springs and one rear main spring, and enables it to change the inner diameter of the cylinder without changing the structure of the entire main springs because the front main springs are structurally mounted at an outer side portion.

The present invention described above is not limited to the aforementioned embodiment and the accompanying drawings. It will be apparent that those skilled in the art can make various substitutions, modifications and changes thereto without departing from the technical spirit of the present invention.

The invention claimed is:

1. A linear compressor, comprising:

a stationary member including a cylinder that provides a space to compress a refrigerant;

a movable member that linearly reciprocates with respect to the stationary member, and that includes a piston that compresses the refrigerant inside the cylinder and a supporter piston connected to the piston and having a support portion that extends in a radial direction of the piston;

a plurality of front main springs positioned so as to be symmetrical with respect to centers of the piston and the supporter piston, one end of each of which is supported by a front surface of the support portion of the supporter piston and the other end of each of which is supported by the stationary member;

a rear main spring positioned at an opposite side of the piston, one end of which is supported by the supporter piston; and a suction muffler positioned inside the rear main spring that communicates with the piston and fastened to the supporter piston by bolts; and a back cover having a support portion that supports the other end of the rear main spring, wherein the support portion comprises an inward constraining support portion that prevents the other end of the rear main spring from moving in a transverse direction on the support portion of the back cover and an outward constraining support portion that prevents the other end of the rear main spring from moving in the transverse direction on the support portion of the back cover so that the other end of the rear main spring is safely seated between the inward constraining support portion and the outward constraining support portion, wherein the inward constraining support portion includes a bent part that is bent toward the cylinder to be inclined inwardly, so as to form a gap between a skirt portion of the bent part and an inner side portion of the rear main spring, which prevents the rear main spring from interfering with the skirt portion, and wherein the inwardly inclined bent part does not hit the suction muffler.

2. The linear compressor of claim 1, wherein the support portion that constrains the rear main spring is concentric with respect to the center of the piston or a center of the cylinder.

3. The linear compressor of claim 1, wherein the outward constraining support portion has a depressed part formed in a direction facing a suction opening direction.

4. The linear compressor of claim 1, wherein the outward constraining support portion has a convex part formed in a direction of the cylinder.

5. The linear compressor of claim 1, wherein the outward constraining support portion is formed by cutting out a part along an edge supporting the other end of the rear main spring and bending the same upwardly.

6. The linear compressor of claim 1, wherein lengths of the plurality of front main springs and the rear main spring are the same when mounted.

7. The linear compressor of claim 1, wherein a center of the rear main spring coincides with the center of the piston.

8. The linear compressor of claim 1, wherein the other end of each of the plurality of front main springs is installed at an outer side of the cylinder.

9. The linear compressor of claim 1, wherein at least two of the plurality of front main springs are provided so as to be symmetrical to the centers of the piston and the supporter piston.

10. The linear compressor of claim 1, wherein the plurality of front main springs and the rear main spring have a natural frequency approximately coinciding with a resonant operation frequency of the piston.

11. The linear compressor of claim 1, wherein the stationary member further comprises a stator cover that supports the other end of the plurality of front main springs.

12. The linear compressor of claim 1, wherein, the portion of the supporter piston that contacts with the plurality of front main springs is surface-treated.

13. The linear compressor of claim 12, wherein the portion of the supporter piston that contacts the plurality of front main springs is surface-treated by any one of NIP coating and anodizing treatment.

14. A linear compressor, comprising:

a stationary member including a cylinder that provides a space to compress a refrigerant;

a movable member that linearly reciprocates with respect to the stationary member, and that includes a piston that compresses the refrigerant inside the cylinder and a supporter piston connected to the piston and having a support portion that extends in a radial direction of the piston;

a plurality of front main springs positioned so as to be symmetrical with respect to centers of the piston and the supporter piston, one end of each of which is supported by a front surface of the support portion of the supporter piston and the other end of each of which is supported by the stationary member;

a rear main spring positioned at an opposite side of the piston, one end of which is supported by the supporter piston; and a suction muffler positioned inside the rear main spring that communicates with the piston and fastened to the supporter piston by bolts, and a back cover having a support portion that supports the other end of the rear main spring, wherein the support portion comprises an inward constraining support portion that prevents the other end of the rear main spring from moving in a transverse direction on the support portion of the back cover and an outward constraining support portion that prevents the other end of the rear main spring from moving in the transverse direction on the support portion of the back cover so that the other end of the rear main spring is safely seated between the inward constraining support portion and the outward constraining support portion, wherein the inward constraining support portion includes a bent part that is bent toward the cylinder to be inclined inwardly from a distal end of the rear main spring, and wherein the inwardly inclined bent part does not hit the suction muffler.

15. The linear compressor of claim 14, wherein a gap is formed between a skirt portion of the bent part and an inner side portion of the rear main spring.

* * * * *